US005329679A

United States Patent [19]

Rojdev

[11] Patent Number: 5,329,679

[45] Date of Patent: Jul. 19, 1994

[54] ARMREST FOR CASKET

[75] Inventor: Ilija Rojdev, Cincinnati, Ohio

[73] Assignee: Batesville Casket Company, Inc., Batesville, Ind.

[21] Appl. No.: 917,151

[22] Filed: Jul. 20, 1992

[51] Int. Cl.[5] ..... A61G 17/04

[52] U.S. Cl. ..... 27/13; 27/1; 5/623; 297/411.23

[58] Field of Search ..... 27/12, 13, 1; 5/623, 5/646; 297/411, 412, 413; 248/118, 118.1, 118.3

[56] References Cited

U.S. PATENT DOCUMENTS

| | | | |
|---|---|---|---|
| 1,973,240 | 1/1934 | Werness et al. | 27/13 |
| 3,345,656 | 10/1967 | Steinman | 248/118 |
| 3,620,566 | 11/1971 | Leconte | 297/412 X |
| 3,799,534 | 3/1974 | Coles | 27/13 |
| 4,730,867 | 3/1988 | Cluba | 297/411 X |
| 4,869,543 | 9/1989 | Grimes | 297/411 X |
| 4,881,306 | 11/1989 | Ernat et al. | 27/12 |
| 5,133,097 | 7/1992 | Pyles | 5/623 |

*Primary Examiner*—Carl D. Friedman
*Assistant Examiner*—Kien Nguyen
*Attorney, Agent, or Firm*—Wood, Herron, & Evans

[57] ABSTRACT

A prop for supporting the arm of a deceased person in a casket of the type having a bed supported by longitudinally-extending angle irons having an angle iron edge portion extending upwardly above the bed, the prop being preferably of foam plastic such as polystyrene and having concave arm-supporting surfaces at one end and on one edge, the member being supported on the angle iron by means of a groove-like depressed area and slot in a side surface which receives the angle iron edge portion. Other mounting of the member is also available to provide support at various heights.

16 Claims, 2 Drawing Sheets

ARMREST FOR CASKET

This invention relates to an armrest for supporting the arm of a deceased in a casket.

BACKGROUND OF THE INVENTION

The body of a deceased reposes in a casket as if in bed. The body rests on a bed-like structure and the arms are generally folded over the abdomen. A prop of some type is usually placed between the upper arm and the bed of the casket. Without such prop, the upper arms tend to rest on the bed and the hands and forearms do not remain in the desired position. This is particularly true when the deceased is obese.

Props that have been used in the past include soft drink cans and bottles, or whatever is at hand. Occasionally, one of the mourners discovers this type of prop, sometimes because the prop slips out of place. Such discovery does not create a good impression, to say the least.

The art has had a long need for a prop that will stay in place, that provides a plurality of heights of support, that is easily positioned at the desired height, is inexpensive, and is not apt to disturb a mourner if seen by such person. It is also desirable for the prop to be lightweight.

A prop according to the present invention meets all of these requirements, as will be readily understood from the following specification and the appended drawings.

Casket beds are relatively thin and are supported on a frame that includes at each side a longitudinally-extending angle iron, a portion of which extends upwardly above the upper surface of the bed. A prop according to a preferred form of the invention comprises a multisurfaced, elongated member, preferably of plastic foam such as polystyrene. In a first side surface of the prop is a transversely-extending, depressed, groove-like area extending the entire width of that surface. A similarly extending slot communicates with the depressed area and extends toward one end of the member. The depressed area and slot are dimensioned to fit over the upwardly-extending portion of the angle iron, with the angle iron portion which lies above the bed extending into the slot. The prop, so positioned, then extends a substantial distance above the bed and can be positioned anywhere along the angle iron to provide the best arm support.

In a preferred embodiment, the prop has a plurality of these depressed area and slot arrangements, so positioned as to provide a selection of heights of support when mounted as just described. The prop preferably has a concavity on one end surface and on one edge surface to receive an arm. The end opposite the concave end surface is preferably flat, as is the side surface opposite the concave edge surface. These flat surfaces can be rested on the bed or on the upper edge of the angle iron in other use positions.

BRIEF DESCRIPTION OF THE DRAWINGS

A preferred form of the invention is shown in the appended drawings in which.

DETAILED DESCRIPTION OF THE INVENTION

Figure 1:
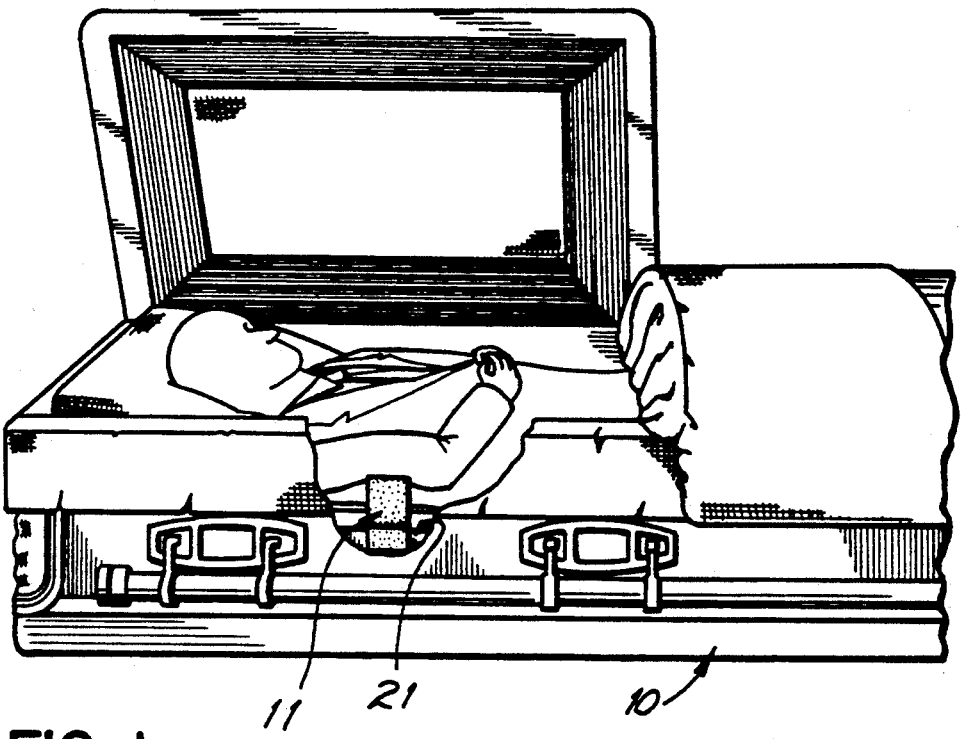
FIG. 1 is a perspective view of a portion of an open casket showing a prop according to the invention in place supporting one arm of the deceased.
Figures 3, 4, 5, 6, 7, 8, 9:
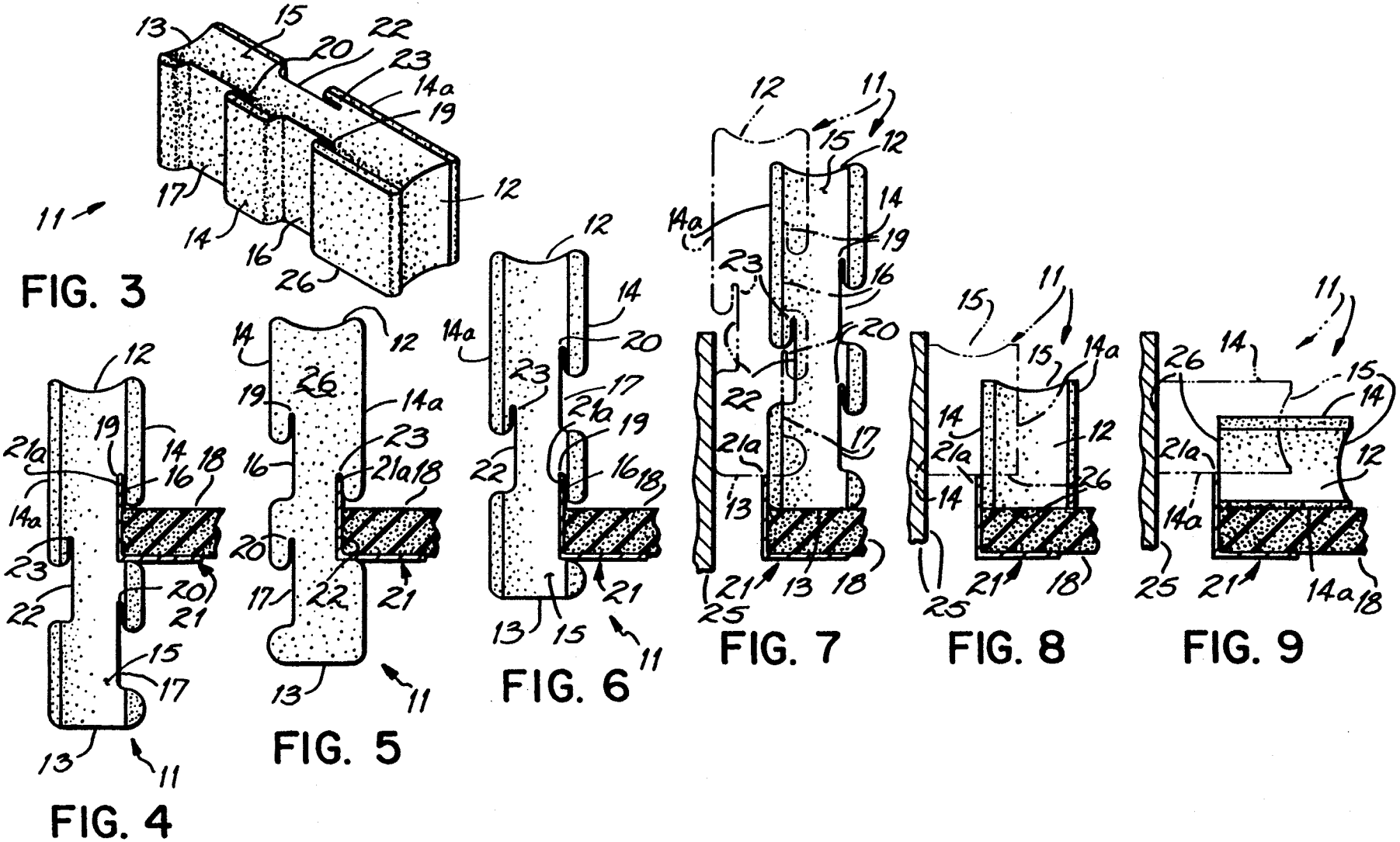
FIG. 3 is a perspective view of a preferred form of a prop according to the invention.
FIGS. 4–6 show positioning of the prop with the angle iron in a slot at various heights, FIG. 4 being a cross section taken on line 4—4 of FIG. 2.
FIG. 7 shows, in solid lines, the prop in one location, with one end resting on the bed, and in another location in broken lines, with one end resting on the upper edge of the angle iron.
FIG. 8 shows, in solid lines, the prop extending longitudinally of the casket, with one longitudinally-extending edge resting on the bed and, in broken lines, with that edge resting on the upper edge of the angle iron.
FIG. 9 shows, in solid lines, the prop extending longitudinally of the casket and with one side resting on the bed, but rotated 90° from the position in FIG. 7, and, in broken lines, the prop oriented as in the solid line showing, but resting on the upper edge of the angle iron.

Referring now to FIG. 1, a casket 10 is shown in open condition with an arm of the deceased supported by a prop 11. In the perspective view of the prop shown in FIG. 3, the prop is elongated, being about eight inches long and rectangular in cross section. One end surface 12 is concave and the opposite end surface 13 is flat and perpendicular to the side surfaces, one of which is seen at 14*a*. The other side surface is seen at 14*a*. One edge surface 15 is concave and the opposite edge surface seen at 26 in FIGS. 5, 8 and 9 is flat and perpendicular to side surfaces 14 and 14*a*. In cross section, the prop is about three inches by two inches.

Side surface 14 has spaced, depressed, groove-like areas at 16 and 17. Each area 16 and 17 extends the full width of the side wall and is about one inch long in the longitudinal direction. Thus, they are slightly larger than the bed thickness, the bed including a mattress being shown at 18. Communicating with each of the respective depressed areas is a slot, as shown at 19 and 20. These slots extend about ½ inch toward concave end 12 of the prop a distance sufficient to receive the upper edge portion or flange 21*a* of an angle iron 21. One of these angle irons extends along each longitudinal edge of mattress 18 to form the frame that supports the mattress.

Surface 14*a* of the prop, seen in particular in FIGS. 3–7, has a depressed area 22 and a slot 23 similar to those on side 14 but located generally opposite the space between depressed areas 16 and 17. Thus, area 22 and slot 23 are intermediate the positions of depressed areas 16 and 17. As will be explained in regard to FIGS. 4–7, the various depressed areas and slots provide multiple choices for selecting the height at which an arm is supported. Other height selections are available from other positions and orientations of the prop as seen in other Figs.

It will be noted that in the preferred embodiment, surfaces 14 and 14*a* are slightly rounded where a slot opening begins, while the other ends of depressed areas 16, 17 and 22 are also slightly rounded. These rounded areas assist in seating the prop on the angle iron in the positions shown in FIGS. 4–6.

Figure 2:
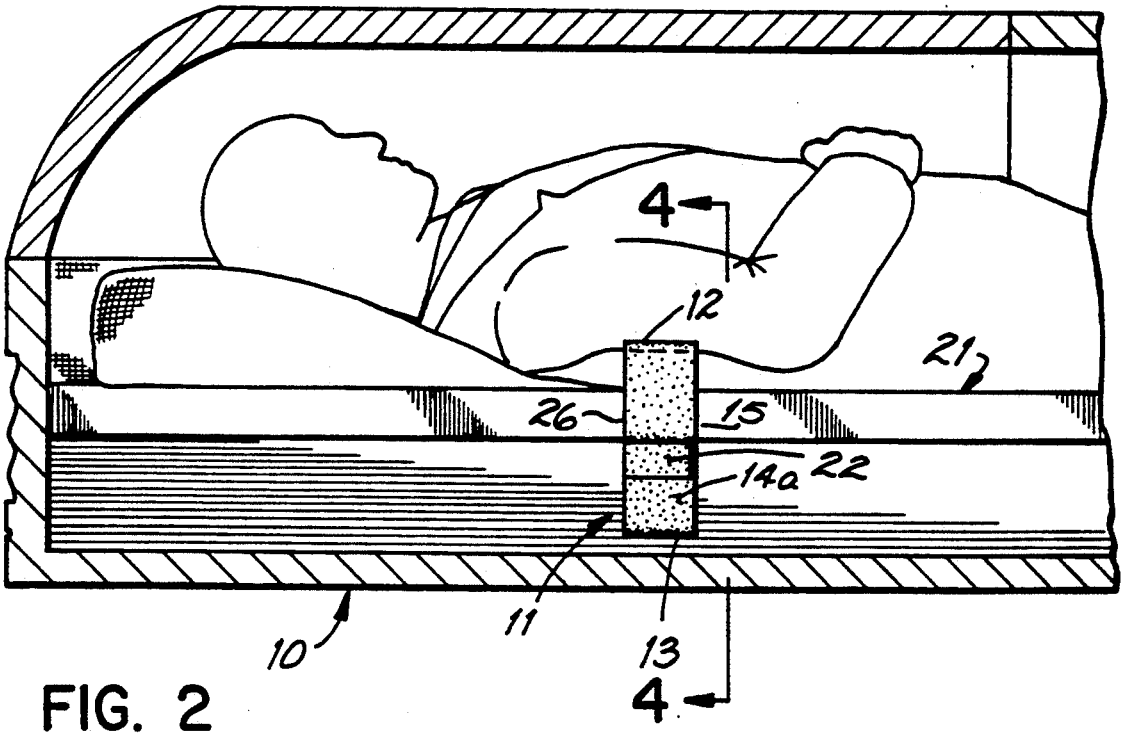
FIG. 2 is a cross-sectional view showing the mounting in more detail.

Turning now to FIG. 4, prop 11 is shown as in FIGS. 1 and 2, with the upwardly-extending portion 21*a* of angle iron 21 positioned in depressed area 16 and slot 19. In FIG. 5, angle iron 21 is in depressed area 22 and slot 23. In FIG. 6, the angle iron is in depressed area 17 and slot 20. Each of these positions places the concave armrest end surface at a different height.

FIG. 7 shows use of the prop in a different manner. In solid lines, flat end 13 of the prop is shown resting on mattress 18, with concave end 12 in arm-supporting position. In broken lines, the prop is shown with its flat end 13 resting on the upper edge of angle iron portion 21*a*, and with one of its side walls, in this case part of prop side wall 14*a*, resting against the casket wall, shown at 25. This is the highest position for concave end 12.

While the above-described figures show the prop in vertical positions, FIGS. 8 and 9 show it in horizontal positions. Taking first FIG. 8, solid lines show the prop resting on mattress 18 and extending longitudinally of the casket. Concave edge surface 15 faces upwardly to provide a relatively low arm support. In broken lines, the prop is shown in a similar orientation, but it is resting on the upper edge of angle iron portion 21*a* instead of on the mattress. In both the solid and broken line versions, concave end surface 12 is shown facing the viewer. Since that surface is not being used in this Fig., it is not material whether it faces toward the head or the foot of the casket.

In FIG. 9, the prop 11 is again extending longitudinally of the casket, but it is positioned with one of the flat surfaces 14 or 14*a* facing down, with the other side surface facing up to provide arm support. As shown in solid lines, side surface 14*a* rests on mattress 18 and side surface 14 provides arm support. Flat edge surface 26 abuts the inside surface of angle iron portion 21*a*. In the broken line showing, side 14*a* rests on the upper edge of angle iron portion 21*a* and flat edge 26 abuts the inner surface of casket side wall 25. As concave end surface 12 is not functioning in this FIG., it does not matter whether it faces toward the head or the foot of the casket. It will be noted that the solid line position of FIG. 9 provides the lowest arm support level using prop 11.

Another orientation, not shown in the drawings, could be used. Prop 11 in such use would be turned 90° from the solid line position of FIG. 9 so that its longitudinal direction extends transversely of the casket. Such positioning could serve not only as an armrest, but also as a body positioned in the case of a very slender deceased. One could also place a second prop on top of a prop so positioned, the second prop being oriented either longitudinally or transversely of the casket. Other positions for use of a plurality of the novel props can also be used.

It should be apparent from the foregoing that the novel prop is useful in a variety of situations, providing a wide variety of support positions, while at the same time being readily manufactured at low cost.

The prop is preferably made of foam plastic for lightness, the material being readily cut to the desired configuration and providing a slight degree of resiliency which assists in sliding the prop into the various mounting positions on angle iron 21, as shown in the drawings. The prop can, of course, be made in various sizes, the measurements given above having been found suitable.

It will be understood that the invention is susceptible of variations from the preferred embodiment disclosed without departing from the spirit and scope of the invention as defined by the appended claims.

Having described my invention, I claim:

1. A prop for supporting the arm of a deceased in combination with a casket, said casket having a bed on which the deceased rests and an angle iron extending longitudinally of the casket along each side of the bed to support the bed, each said angle iron having a portion extending upwardly with its edge above the bed, said prop comprising:

an elongated member having a pair of opposed ends, generally rectangular in cross section, having in one side surface a transversely-extending, depressed area and a transversely-extending slot communicating with said area and extending toward one of said pair of opposed ends of the member, said depressed area and slot being dimensioned to fit over said upwardly-extending angle iron portion, with said angle iron edge extending into said slot to support said member in an upright position extending upwardly above said angle iron and bed to provide arm support.

2. The combination as set forth in claim 1 further comprising:

said member having a plurality of said depressed areas and slots to provide a selection of support positions of variable heights.

3. The combination as set forth in claim 2 further comprising:

there being two of said depressed areas and slots spaced apart along a first said side surface, and a third depressed area and slot on a second side surface and located longitudinally intermediate the positions of said two depressed areas.

4. The combination as set forth in claim 1 further comprising:

the surface at the end of the member toward which said slot extends being concave.

5. The combination as set forth in claim 4 further comprising:

the end surface opposite said concave end surface being flat and perpendicular to said side surface.

6. The combination as set forth in claim 1 further comprising:

said member having two edge surfaces, one of which is concave in cross section.

7. The combination as set forth in claim 6 further comprising:

an edge surface opposite said concave edge surface being flat and perpendicular to said side surface.

8. The combination as set forth in claim 1 further comprising:

said member being of foam plastic material.

9. A prop for supporting the arm of a deceased in combination with a casket, said casket having a bed on which the deceased rests and an angle iron extending longitudinally of the casket along each side of the bed to support the bed, each said angle iron having a portion extending upwardly above the bed, said prop comprising:

an elongated member of foam plastic, generally rectangular in cross section, and having a concave surface at one end and a concave surface extending the length of the member along one edge of the member, and a pair of opposed side surfaces, a first of said side surfaces having a depressed area extending transversely the full width of the member and a similarly extending slot communicating with said area and extending toward said concave end surface, and a second such depressed area and slot spaced away from said concave end surface from said first mentioned depressed area and slot, the second of said side surfaces having a similar depressed area and slot located longitudinally intermediate the positions of said areas and slots in said first side.

10. A prop for supporting the arm of a deceased in a casket comprising:

an elongated member having a pair of opposed ends, generally rectangular in cross section, having in one side surface a transversely-extending, depressed area and a transversely-extending slot communicating with said area and extending toward one of said pair of opposed ends of the member, said depressed area and slot being dimensioned to fit over an upwardly-extending portion of an angle-iron bed support within the casket, with the angle iron edge extending into said slot to support said member in an upright position extending upwardly above the angle iron and bed to provide arm support, said member having a plurality of said depressed areas and slots to provide a selection of support positions of variable heights.

11. The prop of claim 10:

there being two of said depressed areas and slots spaced apart along a first said side surface, and a third depressed area and slot on a second side surface and located longitudinally intermediate the positions of said two depressed areas.

12. A prop for supporting the arm of a deceased in a casket comprising:

an elongated member having a pair of opposed ends, generally rectangular in cross section, having in one side surface a transversely-extending, depressed area and a transversely-extending slot communicating with said area and extending toward one of said pair of opposed ends of the member, said depressed area and slot being dimensioned to fit over an upwardly-extending portion of an angle-iron bed support within the casket, with the angle iron edge extending into said slot to support said member in an upright position extending upwardly above the angle iron and bed to provide arm support, the surface at the end of the member toward which said slot extends being concave.

13. The prop of claim 12 the end surface opposite said concave end surface being flat and perpendicular to said side surface.

14. A prop for supporting the arm of a deceased in a casket comprising:

an elongated member having a pair of opposed ends, generally rectangular in cross section, having in one side surface a transversely-extending, depressed area and a transversely-extending slot communicating with said area and extending toward one of said pair of opposed ends of the member, said depressed area and slot being dimensioned to fit over an upwardly-extending portion of an angle-iron bed support within the casket, with the angle iron edge extending into said slot to support said member in an upright position extending upwardly above the angle iron and bed to provide arm support, said member having two edge surfaces, one of which is concave in cross section.

15. The prop of claim 14 an edge surface opposite said concave edge surface being flat and perpendicular to said side surface.

16. A prop for supporting the arm of a deceased in a casket comprising:

an elongated member having a pair of opposed ends, generally rectangular in cross section, having in one side surface a transversely-extending, depressed area and a transversely-extending slot communicating with said area and extending toward one of said pair of opposed ends of the member, said depressed area and slot being dimensioned to fit over an upwardly-extending portion of an angle-iron bed support within the casket, with the angle iron edge extending into said slot to support said member in an upright position extending upwardly above the angle iron and bed to provide arm support, said member being of foam plastic material.

* * * * *